US005269626A

United States Patent [19]

Soliman et al.

[11] Patent Number: 5,269,626

[45] Date of Patent: Dec. 14, 1993

[54] MACHINE UTILIZING ROAD-MAKING MATERIALS

[75] Inventors: Samir Soliman, Paris; Claude Sibaud, Villefontaine; Jean-Pierre Potier, Rueil Malmaison, all of France

[73] Assignees: Entreprise Jean Lefebvre; Societe Nouvelle Franex, France

[21] Appl. No.: 783,679

[22] Filed: Oct. 29, 1991

[30] Foreign Application Priority Data

Oct. 29, 1990 [FR] France ..... 90 13365

[51] Int. Cl.[5] ..... E01C 19/38

[52] U.S. Cl. ..... 404/108; 404/110

[58] Field of Search ..... 404/102, 108, 110, 133.05, 404/133.2

[56] References Cited

U.S. PATENT DOCUMENTS 2,109,020 2/1938 Abernathy .
3,585,912 6/1971 Danielsson ..... 404/108 X
3,614,916 10/1971 Benson .
4,302,127 11/1981 Hodson ..... 404/102
4,310,293 1/1982 Eggleton ..... 404/108 X
4,765,772 8/1988 Benedetti et al. ..... 404/108 X

FOREIGN PATENT DOCUMENTS 0370135 5/1990 European Pat. Off. .
1400617 7/1975 United Kingdom .

*Primary Examiner*—William P. Neuder
*Attorney, Agent, or Firm*—Stevens, Davis, Miller & Mosher

[57] ABSTRACT

The present invention relates to a machine utilizing road-making materials, in particular for the spreading of road pavement courses intended to be applied in courses of different thicknesses, particularly of asphalt concrete in ultrathin courses, of the type comprising a chassis equipped with rolling means and capable of being coupled to a traction means intended to ensure its movement over the ground, which comprises a hopper (16) for densification and distribution of said material, whose lower orifice (18) is disposed close to the ground, as well as a vibrating bar (38) mounted in the immediate vicinity of the rear transverse edge (40) of said hopper (16).

21 Claims, 1 Drawing Sheet

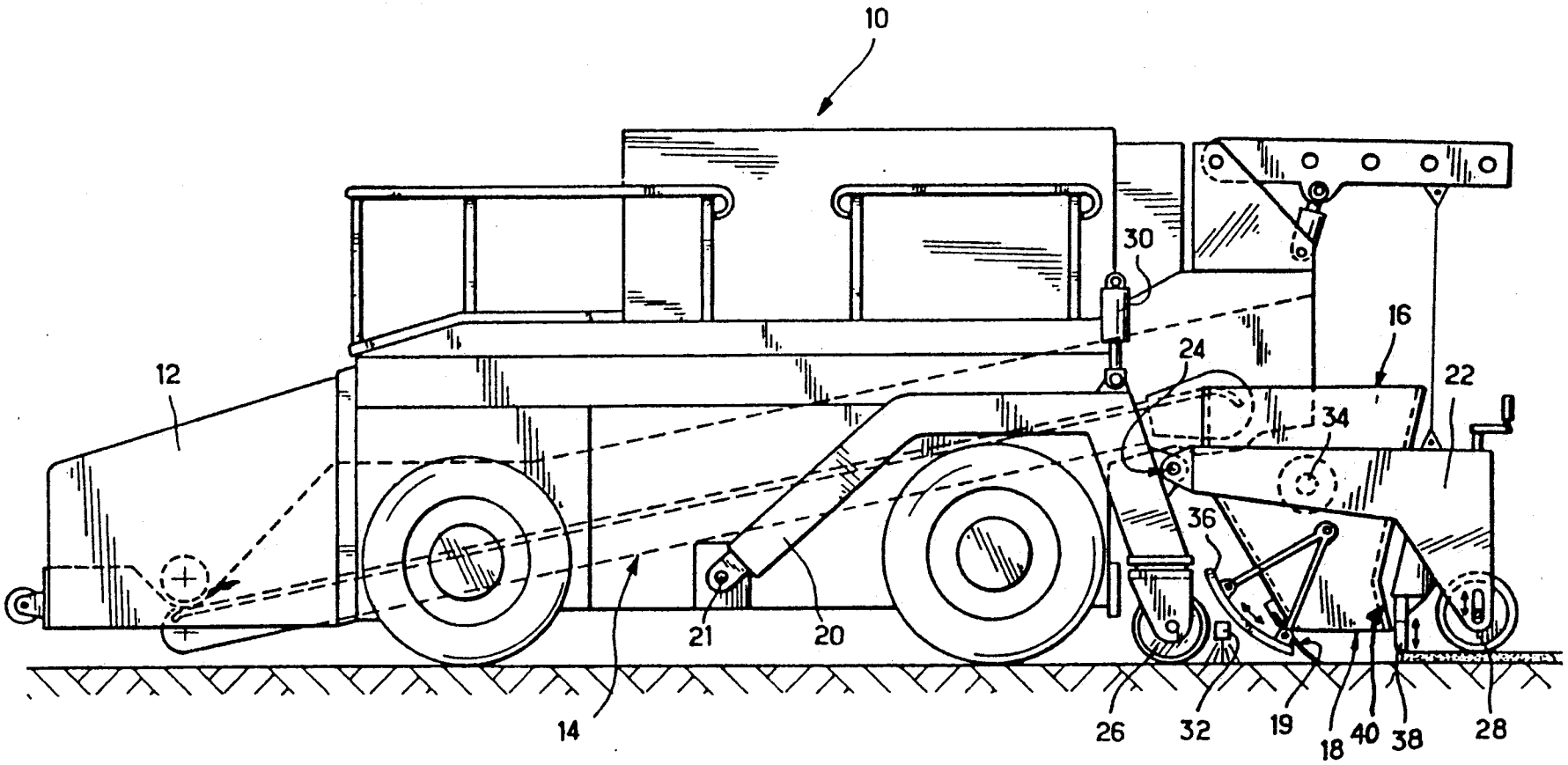
10
12
14
16
18
19
20
21
22
24
26
28
30
32
34
36
38
40

MACHINE UTILIZING ROAD-MAKING MATERIALS

The present invention relates to a machine utilizing road-making materials generally consisting of aggregates which may or may not be precoated with hydraulic asphalt binders, for example asphalt concretes.

BACKGROUND OF THE INVENTION

The machine according to the invention is particularly intended for spreading of road pavement courses which, depending on circumstances, have to be applied either in ultrathin courses with as constant a thickness as possible, or in courses of greater thickness, particularly with a view to reprofiling the highway.

The subject of the present invention thus applies to the field of the maintenance and production of various types of highway courses.

The spreading of asphalt concretes in ultrathin courses, i.e. corresponding to a thickness close to the maximum particle size of the chippings, poses problems which are often difficult and even impossible to solve satisfactorily.

DESCRIPTION OF THE RELATED ART

With current machinery, these difficulties can be overcome only by carefully preparing the foundation in order to give it a reprofiled surface.

In fact, the spreading of ultrathin asphalt concrete courses very often damages the tables of the finishers, which suffer from premature wear due to abrasion in contact with the aggregates which emerge from the ultrathin pavement course.

Finally, the largest chippings are sometimes entrained by the rear edge of the table of the finisher, which gives rise to the chippings being dragged along and causes an uneven surface by combing.

These major disadvantages can be finally overcome with the aid of the utilizing machine according to the invention.

SUMMARY OF THE INVENTION

The machine according to the invention also has the advantage of being able very easily and very rapidly to adapt to the application of other types of pavements, for example to the application of courses of greater thickness, in particular in the case of the reprofiling of very uneven highways.

A further aim of the present invention is to design a machine permitting spreading of road-making materials to be performed at speeds which are much higher than those observed with all conventional types of finishers. With the machine which is the subject of the present invention, it is possible to attain application speeds ranging up to 30 meters per minute.

Other details and features of the invention will stand out from the description given below by way of non-limitative example and with reference to the accompanying drawings, in which:

FIG. 1 shows the machine utilizing road making materials of the present invention.

DESCRIPTION OF THE PREFERRED EMBODIMENT

According to the present invention, the machine utilizing road-making materials is of the type comprising a chassis equipped with rolling means and capable of being coupled to a traction means intended to ensure its movement over the ground. It is defined in that it comprises a hopper for densification and distribution of said material, the lower orifice of the hopper being disposed close to the ground; it is also defined by the presence of a vibrating bar mounted in the immediate vicinity of the rear transverse edge of said hopper.

Moreover, advantageously, the hopper (16) is mounted on articulated arms (22) on a transverse pivoting shaft (24) arranged at the front of said hopper and capable of being supported by idle wheels (26), said arms bearing at the rear of the hopper on a support capable of participating in the compacting (28), such as a smoothing beam and/or a roller.

According to the invention, the articulation on the transverse pivoting shaft (24) may be left free or locked. It is left free so that vertical differences in level recorded by the vehicle are not reflected in the position of the machine relative to the support on the ground, for the utilization of ultrathin courses of virtually constant thickness, or it is locked and the free wheels (26) simultaneously retracted with a view to applying a course surfacing with a reprofiling effect.

In a suitable embodiment, a machine utilizing road-making materials is defined in that the hopper (16) is pulled by said vehicle by means of two arms (20) each articulated on said vehicle on a shaft (21), said lateral arms (22) themselves being articulated on the arms (20) at the level of said transverse pivoting shaft (24).

Other features and advantages of the subject of the present invention will become apparent on reading the detailed description given below, particularly with reference to the appended figure which shows a diagrammatic side view of the machine according to the invention, coupled to a supplier tractor.

The entire lefthand part of the figure bearing the general reference 10 represents a supplier tractor.

This is a special traction means intended to ensure the movement of the machine according to the invention over the ground.

This supplier tractor 10 fulfills the following main functions. By means of its front part, it pushes the semi-trailer trucks during the spreading, it receives and transfers the materials tipped from these trucks into the reception and storage vessel 12, the transfer towards the utilizing apparatus, at a suitable height, being effected via a transfer device, for example a crossbar conveyor 14.

Finally, the supplier tractor must offer a suitable range of speeds of advance.

When implementing spreading of an ultrathin course, the spreading machine according to the present invention is pulled by the self-propelled supplier vehicle 10 without the vertical differences in level recorded by this vehicle being reflected in the position of the apparatus relative to the foundation.

The machine according to the present invention firstly comprises a densification and distribution hopper 16.

Given the height required by the hopper 16, the crossbar conveyor 14 must be arranged at a slant so that its top tipping end is located in line with the upper opening of the densification and distribution hopper 16.

A considerable storage capacity for the material to be applied is thus available.

Firstly, the hopper 16, advantageously having a width of the order of 3 meters, may have, in practice, capacities close to approximately 4 tonnes of precoated materials.

This hopper 16 is also coupled to the supplier tractor 10 which receives the materials and has, to this end, a first reception and storage vessel 12 to which is added the reserve consisting of the stream of materials accumulated on the conveyor 14.

In accordance with the present invention, the densification and distribution hopper 16 has a lower orifice 18 disposed close to the ground.

In practice, this opening 18 is located a few centimeters from the ground so as to avoid any segregation of the road-making material towards the front.

A flap 19 may also be located along the front lower transverse edge of the hopper 16.

This hopper 16 is pulled by means of two arms 20 each articulated on a shaft 21 preferably placed in the center of the wheelbase of the traction vehicle The hopper 16 may, of course, be mounted securely on its chassis with a wheelbase which will be adapted to the particular selected mode of utilization. Thus, a short wheelbase, that is to say the closest possible to the front and rear flanks of the hopper, will make it possible closely to follow the profile along the foundation.

In the particular embodiment described, the hopper 16 is mounted on lateral arms 22 which are themselves articulated on the arms 20 at the level of a transverse pivoting shaft 24 which is arranged at the front of the hopper 16 and which is supported by two idle wheels 26. The lateral arms 22 bear, moreover, at the rear of the hopper 16, on a precompacting device. The latter may consist of a smoothing beam and/or a roller. One and/or the other of the two precompacting devices may advantageously be driven by a vibratory movement.

In the embodiment shown, this precompacting device is a roller 28.

Of course, the hopper is mounted in a manner enabling it to be raised, principally for transfer, by means of two jacks 30 placed on either side of the hopper.

The hopper for densification and distribution of the road-making material has a shape which has been determined in order to ensure a satisfactory continuous flow of said material.

In practice, such a hopper 16 may have a cross-section, in the direction of advance of the machine, which becomes narrower towards the bottom. To this end, one and/or the other of the front and rear transverse walls of this hopper 16 may be inclined.

In practice, the determination of the particular shape of the hopper, which may possibly depend on the particular nature of the road-making material being spread, in fact results from a tradeoff between the need to ensure a continuous flow of the material and the requirement to maintain a sufficient filling height in order to enable the material accumulated in the hopper 16 to carry out a densification function through the action of its own weight, at the base of the hopper.

Clearly, the densification function is of special interest in the application of courses of a certain thickness, but it also offers an advantage which is decisive in the case of the application of ultrathin courses, given that, in such a situation, through the action of the weight of the material accumulated in the hopper 16, a pressure on the ground is obtained which promotes the fixing of the aggregates in the bonding course.

With a view to ensuring the deposition of such a bonding course, the assembly as shown in the appended figure may also be equipped with a transverse boom for spraying asphalt binders, bearing the reference 32.

Of course, the spraying boom 32 is disposed at the front of the hopper 16 and can be supplied from a replenisher truck following the machine.

Various tests have been carried out in order to determine what the mean filling height of the hopper should be, during continuous operation, to provide a satisfactory function of densification, distribution and bonding of the aggregate on the bonding course.

A minimum filling height of between 0.5 and 1.2 meters, particularly a height of approximately 0.8 m, was observed to give entirely satisfactory results.

It will also be pointed out that, in the case of a hopper having a transverse dimension of 3 meters, the opening 18 had a transverse dimension close to 80 centimeters.

During these trials, tests involving the spreading of ultrathin and traditional asphalt concretes performed under these conditions proved entirely satisfactory.

However, it is possible to improve the utilization conditions by using a heat-insulated hopper 16.

As indicated diagrammatically on the appended drawing, the particular assembly of the hopper 16 on the chassis permits the application of the material in ultrathin courses.

To this end, the hopper is mounted on arms 22 articulated on a pivoting shaft 24, which is arranged at the front of said hopper and is supported by the idle wheels 26. In this case, spreading is ensured at a constant thickness.

The articulation of the transverse pivoting shaft 24 is capable of being locked and the idle wheels 26 may be simultaneously retracted, this converting this method of mounting the hopper into another type of mounting which makes it possible to ensure a pavement of courses which is generally applied more thickly.

A transverse screw 34 ensuring the distribution of the material accumulated in the hopper is advantageously mounted in the upper part of the latter.

In practice, it is possible to use a screw having inverted threads which tend to convey the central accumulation cone of the material in the direction of the lateral walls of the hopper 16.

Still in the upper part of the hopper 16, it may also be advantageous to arrange feelers for detecting the minimum level of the material, these feelers being designed in order to monitor the device supplying the hopper.

It will be understood that this results in a height of material under the distribution screw 34 which is sufficiently large to ensure a useful volume of material, providing, moreover, a storage function required for continuous working, which makes it possible to avoid the detrimental consequences of machine stoppages caused by supplier truck changeovers.

Clearly, this accumulation phenomenon in the hopper 16 also makes it possible to fulfil the function of densification of the materials through the action of their own weight.

The hopper 16 is also equipped with a closure device 36 which makes it possible to close the lower part of the hopper 16.

In the closed position, the closure device 36 cuts off the stream of material contained in the hopper in contact with the foundation and consequently isolates the contents of the hopper from the foundation, which makes it possible to obtain stoppages and restarts having clear and straight transverse edges.

In order to restart the machine, the closure device 36 is retracted by a hydraulic control jack, which once again makes it possible to release the material contained in the hopper.

The second essential element of the patented combination consists of the vibrating bar bearing the general reference 38, which is mounted in the immediate vicinity of the rear transverse edge 40 of the hopper.

Without rear supports on a horizontal plate, as is the case with existing finisher-type machines.

The vibrating bar 38 is driven by a vibratory movement which is either in one direction or in several directions. Vibratory movements in one direction will generally be vertical.

The frequency of the vibrations of the bar 38 can be adjusted between values of between 5 and 50 Hz.

In practice, a vibration frequency of the order of 25 Hz led to perfectly satisfactory results.

The amplitude of the vibrations of the bar 38 may also be adjusted, for example in the ranges of values between 1 and 8 millimeters. In the case of a bar vibrating in the vertical direction with a frequency of the order of 25 Hz, a variation amplitude of the order of 4 millimeters led to perfectly satisfactory results in the case of conventional asphalt concretes.

Finally, clearly, the vibrating bar 38 itself is mounted on a support which can be adjusted in respect of vertical position.

Finally, it should be added that, advantageously, the rear edge 40 of the hopper 16 is equipped with a deflector plate (not shown in detail) disposed advantageously in contact with the vibrating bar 38. Placing this deflector plate in contact with the bar 38 may be achieved in practice with the aid of an elastic return means.

From a functional point of view, it will be pointed out that the vibration of the bar 38 contributes to the mutual bedding-in of the aggregates on the bonding course, particularly if very thin courses are produced, that is to say when the thickness of the course is close to the largest particle size of the material utilized.

It will finally be specified that the vibrating bar 38 is designed with a profile which makes it possible to facilitate the cutting-up or the shearing of the material as well as its positioning on the bonding course.

A device for adjusting the camber at the center of this vibrating bar 38 makes it possible to spread the materials as a covering layer, positively or negatively.

This vibrating bar is advantageously produced so that it can be hydraulically or mechanically extended at the level of these two free ends, which makes it possible to achieve variable working widths.

Such telescopic extensions of the vibrating bar 38 also make it possible to enhance the production of joins, the monitoring of borders and the like, since they can be manually or automatically controlled as a function of particular situations.

In order to supply this additional part with pavement material, it is possible to provide, on the lateral faces of the hopper 16, in their lower part, kinds of cat-flaps closed by retractable shutters.

When the cat-flaps are open, additional material is delivered in order temporarily to ensure wider working widths.

Another method of varying the working width consists in producing a telescopic hopper.

We claim:

1. A machine utilizing road-making materials, in particular for the spreading of road pavement courses intended to be applied in courses of different thicknesses, particularly of asphalt concrete in ultrathin courses, of the type comprising a chassis equipped with rolling means and capable of being coupled to a traction vehicle (10) intended to endure its movement over the ground, which comprises a hopper (16) for densification and distribution of said material, whose lower orifice (18) extends transversely the width of the spread layer and is disposed close to the ground, as well as a vibrating bar (38) mounted in the immediate vicinity of the rear transverse edge (40) of said hopper (16).

2. The machine utilizing road-making materials as claimed in claim 1, wherein the hopper (16) is mounted on arms (22) which are freely articulated on a transverse pivoting shaft (24) arranged at the front of said hopper and supported by idle wheels (26), said arms bearing at the rear of the hopper on a precompacting device (28), such as a smoothing beam and/or a roller, such that the vertical differences in level recorded by this vehicle are not reflected in the position of the machine relative to the ground, with a view to the spreading of the pavement in an ultrathin course, it being possible for the articulation on the transverse pivoting shaft (24) to be locked and the idle wheels (26) to be simultaneously retracted with a view to applying a course pavement with a reprofiling effect.

3. The machine utilizing road-making materials as claimed in claim 2, wherein the hopper (16) is pulled by said vehicle by means of two arms (20) each articulated on said vehicle on a shaft (21), said lateral arms (22) themselves being articulated on the arms (20) at the level of said transverse pivoting shaft (24).

4. The machine utilizing road-making materials as claimed in claim 3, wherein the hopper (16) has a specific shape in order to ensure a satisfactory continuous flow of said material.

5. The machine utilizing road-making materials as claimed in claim 4, wherein the hopper (16) has a large filling height making it possible to continuously receive a quantity of material which is sufficient to ensure its densification through the action of its own weight.

6. The machine utilizing road-making materials as claimed in claim 3, wherein the hopper (16) has a large filling height making it possible to continuously receive a quantity of material which is sufficient to ensure its densification through the action of its own weight.

7. The machine utilizing road-making materials as claimed in claim 2, wherein the hopper (16) has a specific shape in order to ensure a satisfactory continuous flow of said material.

8. The machine utilizing road-making materials as claimed in claim 7, wherein the hopper (16) has a large filling height making it possible to continuously receive a quantity of material which is sufficient to ensure its densification through the action of its own weight.

9. The machine utilizing road-making materials as claimed in claim 2, wherein the hopper (16) has a large filling height making it possible to continuously receive a quantity of material which is sufficient to ensure its densification through the action of its own weight.

10. The machine utilizing road-making materials as claimed in claim 1, wherein the hopper (16) has a specific shape in order to ensure a satisfactory continuous flow of said material.

11. The machine utilizing road-making materials as claimed in claim 10, wherein the hopper (16) has a large filling height making it possible to continuously receive a quantity of material which is sufficient to ensure its densification through the action of its own weight.

12. The machine utilizing road-making materials as claimed in claim 1, wherein the hopper (16) has a large filling height making it possible to continuously receive a quantity of material which is sufficient to ensure its densification through the action of its own weight.

13. The machine utilizing road-making materials as claimed in claim 1, wherein the mean filling height of the hopper, during operation, is between 0.5 and 1.2 meters.

14. The machine utilizing road-making materials as claimed in claim 1, wherein a transverse screw (34) for distributing the material is mounted in the upper part of the hopper (16).

15. The machine utilizing road-making materials as claimed in claim 1, wherein, at the upper part of the hopper, feelers for detecting the minimum level of the material are arranged, said feelers being capable of monitoring a device supplying the hopper.

16. The machine utilizing road-making materials as claimed in claim 15, wherein the hopper comprises a movable closure device (36) for the lower orifice (18).

17. The machine utilizing road-making materials as claimed in claim 1, wherein the vibrating bar (38) is driven by a vibratory movement in one direction or in several directions.

18. The machine utilizing road-making materials as claimed in claim 17, wherein the frequency of the vibrations of the vibrating bar (38) can be adjusted between 5 and 50 Hz.

19. The machine utilizing road-making materials as claimed in claim 18, wherein the vibration amplitude of the vibrating bar (38) can be adjusted between 1 and 8 millimeters.

20. The machine utilizing road-making materials as claimed in claim 17, wherein the vibration amplitude of the vibrating bar (38) can be adjusted between 1 and 8 millimeters.

21. The machine utilizing road-making materials as claimed in claim 1, wherein the vibrating bar (38) is mounted on a support which can be adjusted in terms of height.

* * * * *